US009539634B2

(12) United States Patent
Komiya

(10) Patent No.: US 9,539,634 B2
(45) Date of Patent: Jan. 10, 2017

(54) DIE APPARATUS AND CONTROL METHOD

(71) Applicant: MITSUI HIGH-TEC , INC., Kitakyushi-shi, Fukuoka (JP)

(72) Inventor: Daisuke Komiya, Fukuoka (JP)

(73) Assignee: MITSUI HIGH-TEC, INC., Fukuoka (JP)

( * ) Notice: Subject to any disclaimer, the term of this patent is extended or adjusted under 35 U.S.C. 154(b) by 85 days.

(21) Appl. No.: 14/559,287

(22) Filed: Dec. 3, 2014

(65) Prior Publication Data

US 2015/0158072 A1 Jun. 11, 2015

(30) Foreign Application Priority Data

Dec. 6, 2013 (JP) ..... 2013-253244

(51) Int. Cl.
*B21D 45/06* (2006.01)
*B21D 28/14* (2006.01)
*B21D 45/00* (2006.01)

(52) U.S. Cl.
CPC ..... *B21D 28/14* (2013.01); *B21D 45/006* (2013.01); *B21D 45/06* (2013.01); *Y10T 83/0448* (2015.04); *Y10T 83/217* (2015.04)

(58) Field of Classification Search
CPC ..... B21D 28/14; B21D 45/06; B21D 45/006; Y10T 83/0448; Y10T 83/217
See application file for complete search history.

(56) References Cited

U.S. PATENT DOCUMENTS 2,325,311 A * 7/1943 Ducklo ..... B21D 28/14 83/176
2,674,780 A * 4/1954 Nielsen ..... B21D 28/14 29/34 R
3,254,550 A * 6/1966 McDonald ..... B21D 28/14 83/128

(Continued)

FOREIGN PATENT DOCUMENTS

CN 102218468 10/2011
CN 203030707 7/2013

(Continued)

OTHER PUBLICATIONS

Chinese Office Action for CN App. No. 201410743805.5 issued on Oct. 26, 2016, along with English-language translation thereof.

*Primary Examiner* — Sean Michalski
(74) *Attorney, Agent, or Firm* — Greenblum & Bernstein, P.L.C.

(57) ABSTRACT

A die apparatus includes a tip end part blanking punch which forms a tip end configuration of a belt-shaped sheet through a punch holding unit in an upper die. The punch holding unit includes a punch plate which holds the tip end part blanking punch, a punch plate moving mechanism which is lowered together with the upper die in a state where the punch plate is separated from the upper die when the tip end configuration of the belt-shaped sheet is formed, and holds the punch plate in a state where the punch plate is allowed to come near to the upper die when the punch plate is lifted, and an actuating mechanism which operates the punch plate moving mechanism in cooperation with a blanking or stamping operation of the upper die only when the tip end configuration of the belt-shaped sheet is formed.

7 Claims, 7 Drawing Sheets

(56) References Cited

U.S. PATENT DOCUMENTS

| | | | | | |
|---|---|---|---|---|---|
| 3,516,317 | A | * | 6/1970 | Patterson | B21D 22/00<br>83/466.1 |
| 3,550,491 | A | * | 12/1970 | Wingard | B21D 28/14<br>83/123 |

FOREIGN PATENT DOCUMENTS

| | | |
|---|---|---|
| DE | 29901236 | 4/1999 |
| JP | 06-012943 | 2/1994 |
| JP | 07-204754 | 8/1995 |

* cited by examiner

DIE APPARATUS AND CONTROL METHOD

CROSS REFERENCE TO RELATED APPLICATIONS

This application is based upon and claims the benefit of priority of Japanese Patent Application No. 2013-253244 filed on Dec. 6, 2013, the contents of which are incorporated herein by reference in its entirety.

BACKGROUND OF THE INVENTION

1. Field of the Invention

The present invention relates to a die apparatus and a control method of the die apparatus which is used to manufacture a laminated iron core forming a stator or a rotor of an armature and blanks or stamps and forms an iron core.

2. Description of the Related Art

Usually, when an iron core which forms a laminated iron core by which a stator or a rotor of an armature is constructed is blanked or stamped and formed from a belt-shaped sheet by using a die apparatus, in the belt-shaped sheet, pilot holes for positioning are initially formed at both sides in a width direction of the belt-shaped sheet (a direction intersecting at right angles to a longitudinal direction of the belt-shaped sheet). Then, the belt-shaped sheet is fed progressively in the die apparatus with reference to positions of the pilot holes to sequentially carry out prescribed blanking or stamping works. In this case, in the die apparatus, multi-row iron cores are taken in order to improve a yield of the belt-shaped sheet and a productivity of the iron cores.

When the multi-row iron cores are taken, positions of the blanking or stamping works of the rows are respectively arranged in a zigzag manner (the positions are not present in the same straight lines parallel to the width direction of the belt-shaped sheet and shift in the longitudinal direction (a forward direction) of the belt-shaped sheet). Accordingly, in the blanking or stamping work carried out every time the belt-shaped sheet is progressively fed, blanked or stamped forms are different respectively for the rows. Thus, when the belt-shaped sheet is allowed to enter the die apparatus as in the case that a single row of the iron core is taken to carry out the blanking or stamping work, a half blanking or stamping work (an incomplete partial blanking) arises.

Thus, in an inlet side of the die apparatus, a tip end blanking device which blanks or stamps and forms a tip end part of the belt-shaped sheet is installed. Before the belt-shaped sheet enters the die apparatus, the tip end part of the belt-shaped sheet is cut out so as to meet respectively the shifts of the positions of the blanking or stamping works of the rows, and then, the belt-shaped sheet is allowed to enter the die apparatus (for instance, see JP-A-7-204754). Thus, when the pilot hole is blanked or stamped, an incomplete blanking or stamping work is prevented from being carried out in other rows at the same time and blanked or stamped residue is prevented from sticking to the belt-shaped sheet to form an indentation on the iron core.

Here, the blanking or stamping work of the tip end part of the belt-shaped sheet by the tip end blanking device is necessary only when the tip end part of the belt-shaped sheet is fed to the die apparatus. When the blanking or stamping work of the iron core is carried out by the die apparatus, the tip end blanking device does not need to be operated. Accordingly, the tip end blanking device includes a tip end receiving tool which protrudes when the tip end part of the belt-shaped sheet is blanked or stamped and formed to receive the tip end of the belt-shaped sheet, a tip end blanking die and an intermittent blanking mechanism (for instance, see JP-B-6-12943) having a tip end blanking punch which operates in cooperation with the protrusion of the tip end receiving tool.

SUMMARY OF THE INVENTION

Here, the intermittent blanking mechanism includes, as shown in FIG. 7A and FIG. 7B, a tip end blanking punch 80, a cam 82 which changes and adjusts a position of the tip end blanking punch 80 between upper and lower positions in an upper die 81, a driving cylinder 83 which operates the cam 82 and a control valve 84 which controls the driving cylinder 83. Accordingly, a structure of the tip end blanking device is large-scaled, and a problem arises that the tip end blanking device is enlarged and a production cost is increased.

Since a frequency of operation of the tip end blanking device is lower than that of the die apparatus, the driving cylinder and the control valve may be advantageously removed from the tip end blanking device to manually operate the cam and reduce the production cost. However, when a cam operation is missing after the tip end part of the belt-shaped sheet is blanked or stamped and formed, the belt-shaped sheet blanked or stamped and formed by the tip end blanking device is progressively fed in the die apparatus. Thus, a fear arises that a part of a blanked or stamped material remains in the die apparatus to break the die apparatus.

The present invention is devised by considering the above-described circumstances and it is an object to provide a die apparatus and a control method of the die apparatus which can carry out a previous work of a tip end part of a belt-shaped sheet and blank or stamp and form multi-row iron cores subsequently to the previous work of the tip end part.

A die apparatus according to a first aspect of the present invention is configured to include: an upper die including a stripper plate and a blanking punch; and a lower die including a blanking die, wherein a progressively fed belt-shaped sheet is allowed to abut on the blanking die by the stripper plate and a blanking or stamping work is sequentially carried out on the belt-shaped sheet by using the blanking punch to blank or stamp out an iron core, the die apparatus including: a tip end part blanking punch provided in a receiving side for the belt-shaped sheet in the upper die to form a tip end configuration of the belt-shaped sheet through a punch holding unit, wherein the punch holding unit includes: a punch plate which holds the tip end part blanking punch; a punch plate moving mechanism which is lowered together with the upper die in a state where the punch plate is separated from the upper die when the tip end configuration of the belt-shaped sheet is formed, and holds the punch plate in a state where the punch plate is allowed to come near to the upper die when the punch plate is lifted, and an actuating mechanism which operates the punch plate moving mechanism in cooperation with a blanking or stamping operation of the upper die only when the tip end configuration of the belt-shaped sheet is formed, and wherein when the tip end part blanking punch reaches a bottom dead center, an end of the tip end part blanking punch is protruded downward from a lower surface of the stripper plate, whereas when the belt-shaped sheet is blanked or stamped by the blanking punch after the tip end configuration of the belt-shaped sheet is formed, the end of the tip end part blanking punch is held above the lower surface of the stripper plate.

The die apparatus according to the first aspect of the present invention may be configured so that the punch plate moving mechanism includes: a fixed plate which is provided in an upper part of the punch plate so as to be urged upward and has a first irregular area with first protruding parts formed in an upper part at prescribed pitches; and a movable plate which is attached to the upper die so as to be movable in a width direction of the upper die and urged toward one side in the width direction and has a second irregular area in a lower part of the other side in the width direction with second protruding parts formed at prescribed pitches opposite to the first irregular area, wherein the second protruding parts of the second irregular area are butted against the first protruding parts of the first irregular area to separate the punch plate from the upper die, whereas the first protruding parts of the first irregular area are fitted to second recessed parts of the second irregular area to allow the punch plate to come near to the upper die.

The die apparatus according to the first aspect of the present invention may be configured so that at least one sides of side surfaces which respectively form the first and second protruding parts and the first and second recessed parts of the first and second irregular areas are inclined surfaces, and the movable plate is moved in the width direction of the upper die so that the first and second irregular areas are engaged with each other and disengaged from each other.

The die apparatus according to the first aspect of the present invention may be configured so that an end of the second protruding part, a bottom of a second recessed part of the second irregular area and an end of the first protruding part form horizontal planes, respectively, a height of the second protruding part is lower than a height of the first protruding part, a length of the first protruding part along the width direction of the upper die is shorter than a length of the bottom of the second recessed part of the second irregular area along the width direction of the upper die, and an inclined side surface of one side of the second protruding part is parallel to an inclined side surface of the other side of the first protruding part, and an inclined side surface of the other side of the second protruding part is parallel to an inclined side surface of one side of the first protruding part.

The die apparatus according to the first aspect of the present invention may be configured so that the fixed plate is urged toward the upper die through a first resilient member and the movable plate is urged toward the one side in the width direction through a second resilient member.

The die apparatus according to the first aspect of the present invention may be configured so that the actuating mechanism includes: a first engaging member which is attached so as to vertically pass through a receiving side of a stripper holder that holds the stripper plate, and urged upward with an upper part of the first engaging member engaged with a first engagement part in the one side of the movable plate; and a second engaging member which is provided in a lower surface of the receiving side of the stripper holder and urged inside in the width direction of the stripper holder with a tip end part of the second engaging member engaged with a second engagement part in a lower side of the first engaging member which protrudes below the lower surface of the stripper holder, wherein an operation of the tip end part blanking punch is configured to be stopped by the following state transitions of the actuating mechanism: in a state where the first engaging member is engaged with the first engagement part, the second engaging member is disengaged from the second engagement part; when the upper die is lowered, the second engaging member is engaged with the second engagement part to lock the first engaging member; and when the upper die is lifted, the first engaging member is disengaged from the first engagement part and the movable plate is moved toward the one side in the width direction so that the first and second irregular areas are engaged with each other.

A control method according to a second aspect of the present invention is configured in a die apparatus that includes: an upper die including a stripper plate and a blanking punch; and a lower die including a blanking die, wherein a progressively fed belt-shaped sheet is allowed to abut on the blanking die by the stripper plate and a blanking or stamping work is sequentially carried out on the belt-shaped sheet by using the blanking punch to blank or stamp out an iron core, the control method including: providing a tip end part blanking punch which forms a tip end configuration of the belt-shaped sheet in a receiving side for the belt-shaped sheet in the upper die; allowing an end of the tip end part blanking punch to protrude downward from a lower surface of the stripper plate when the tip end configuration of the belt-shaped sheet is formed; and holding an end of the tip end part blanking punch above a position of the lower surface of the stripper plate when the belt-shaped sheet is blanked or stamped by the blanking punch after the tip end configuration of the belt-shaped sheet is formed.

In the die apparatus according to the first aspect of the present invention, when the tip end configuration of the belt-shaped sheet is formed, the punch plate is lowered together with the upper die in a state where the punch plate is separated from the upper die and when the punch plate is lifted, and the punch plate is held in a state where the punch plate is allowed to come near to the upper die. Thus, the tip end configuration of the belt-shaped sheet can be formed only when the tip end part of the belt-shaped sheet is fed to the die apparatus. After that (for instance, multi-row iron cores are taken from the belt-shaped sheet by the die apparatus), the tip end configuration of the belt-shaped sheet can be prevented from being formed. Thus, when the multi-row iron cores are taken from the belt-shaped sheet, blanked or stamped residue by the tip end part blanking punch can be prevented from being generated in the die apparatus and a cutting tool of the die apparatus can be assuredly prevented from being broken.

In the die apparatus according to the first aspect of the present invention, the punch plate moving mechanism includes the fixed plate which is provided in the upper part of the punch plate so as to be urged upward and has the first irregular area with the first protruding parts formed in the upper part at prescribed pitches and the movable plate which is attached to the upper die so as to be movable in the width direction and urged toward the one side in the width direction and has the second irregular area in the lower part of the other side in the width direction with the second protruding parts formed at prescribed pitches opposite to the first irregular area. The second protruding parts of the second irregular area are butted against the first protruding parts of the first irregular area to separate the punch plate from the upper die. The first protruding parts of the first irregular area are fitted to the second recessed parts of the second irregular area to allow the punch plate to come near to the upper die. Thus, by a simple structure, the punch plate can be held in a state where the punch plate is separated from the upper die or the punch plate is allowed to come near to the upper die.

In the die apparatus according to the first aspect of the present invention, at least the one sides of the side surfaces which respectively form the first and second protruding parts and the first and second recessed parts of the first and second irregular areas are the inclined surfaces. The movable plate is moved in the width direction of the upper die, so that the first and second irregular areas are engaged with each other and disengaged from each other. Thus, when the movable plate is moved forward and backward along the width direction, the fixed plate can be moved upward and downward. Accordingly, the punch plate can be held in the state where the punch plate is separated from the upper die or the punch plate is allowed to come near to the upper die through the upward and downward movement of the fixed plate.

In the die apparatus according to the first aspect of the present invention, the end of the second protruding part, the bottom of the second recessed part of the second irregular area and the end of the first protruding part form horizontal planes, respectively. The height of the second protruding part is lower than the height of the first protruding part. The length of the first protruding part along the width direction of the upper die is shorter than the length of the bottom of the second recessed part of the second irregular area along the width direction of the upper die. Further, the inclined side surface of the one side of the second protruding part is parallel to the inclined side surface of the other side of the first protruding part. The inclined side surface of the other side of the second protruding part is parallel to the inclined side surface of the one side of the first protruding part. Thus, when the movable plate is moved, since the fixed plate is lifted while the side surface of the one side of the first protruding part is allowed to abut on the side surface of the other side of the second protruding part of the movable plate, the fixed plate (the tip end part blanking punch) can be gradually lifted together with the movement of the movable plate. Further, when the end of the first protruding part of the fixed plate abuts on the bottom of the second recessed part of the second irregular area, the lifting movement of the fixed plate (the tip end part blanking punch) can be stopped. Then, the movable plate is further moved in the state where the first protruding part of the fixed plate abuts on the bottom of the recessed part of the second irregular area. When the side surface of the one side of the second protruding part abuts on the side surface of the other side of the first protruding part, the movable plate stops its movement. As a result, the fixed plate is fixed to the upper die through the movable plate.

In the die apparatus according to the first aspect of the present invention, the fixed plate is urged toward the upper die through the first resilient member and the movable plate is urged toward the one side in the width direction through the second resilient member. Thus, by a simple structure, the fixed plate and the movable plate can be respectively moved, the die apparatus can be made to be compact and a production cost can be reduced.

In the die apparatus according to the first aspect of the present invention, the actuating mechanism includes the first engaging member which is attached so as to vertically pass through the receiving side of the stripper holder that holds the stripper plate, and urged upward with the upper part of the first engaging member engaged with the first engagement part in the one side of the movable plate and the second engaging member which is provided in the lower surface of the receiving side of the stripper holder and urged inside in the width direction of the stripper holder with the tip end part of the second engaging member engaged with the second engagement part in the lower side of the first engaging member which protrudes below the lower surface of the stripper holder. The operation of the tip end part blanking punch is stopped by the following state transitions of the actuating mechanism. In a state where the first engaging member is engaged with the first engagement part, the second engaging member is disengaged from the second engagement part. When the upper die is lowered, the second engaging member is engaged with the second engagement part to lock the first engaging member. When the upper die is lifted, the first engaging member is disengaged from the first engagement part, and the movable plate is moved toward the one side in the width direction so that the first and second irregular areas are engaged with each other. Thus, by a simple structure, the punch plate moving mechanism can be operated by the cooperating movement of the first and second engaging members.

In the control method in the die apparatus according to the second aspect of the present invention, the end of the tip end part blanking punch is allowed to protrude downward from the lower surface of the stripper plate when the tip end configuration of the belt-shaped sheet is formed and the end of the tip end part blanking punch is held above the lower surface of the stripper plate when the belt-shaped sheet is blanked or stamped by the blanking punch after the tip end configuration of the belt-shaped sheet is formed. Accordingly, for instance, when the multi-row iron cores are taken from the belt-shaped sheet, the blanked or stamped residue by the tip end part blanking punch can be prevented from being generated in the die apparatus and the cutting tool of the die apparatus can be assuredly prevented from being broken.

DETAILED DESCRIPTION OF THE EXEMPLARY EMBODIMENTS

Subsequently, by referring to the accompanying drawings, an exemplary embodiment which embodies the present invention will be described for readers to understand the present invention.

Figure 1:
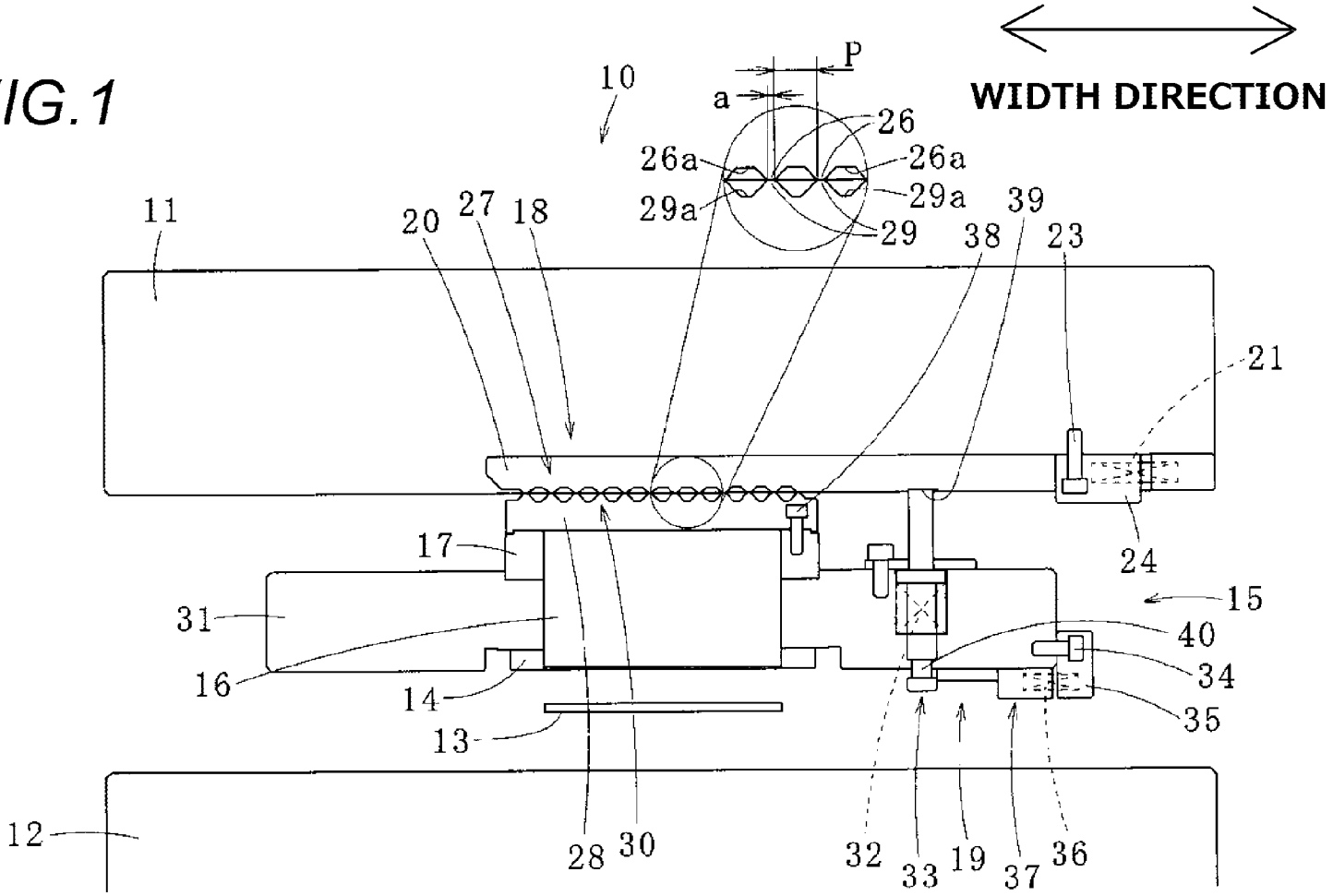
FIG. 1 is a front view when a tip end side of a belt-shaped sheet is inserted into a die apparatus according to an exemplary embodiment of the present invention.

A die apparatus 10 according to an exemplary embodiment of the present invention is, as shown in FIG. 1, an apparatus which includes an upper die 11 and a lower die 12 to allow a progressively fed belt-shaped sheet 13 to abut on a blanking die (not shown in the drawing) of the lower die 12 by a stripper plate 14 provided in the upper die 11 and sequentially carry out a blanking or stamping work by using a blanking punch (not shown in the drawing) provided in the upper die 11 so as to blank or stamp out an iron core (for instance, multi-row iron cores are obtained). Further, in a receiving side for the belt-shaped sheet 13 in the upper die 11, a tip end part blanking punch 16 which forms a tip end configuration of the belt-shaped sheet 13 before the iron cores are blanked or stamped is provided through a punch holding unit 15.

The punch holding unit 15 includes a punch plate 17 which holds the tip end part blanking punch 16, a punch plate moving mechanism 18 which is lowered together with the upper die 11 in a state where the punch plate 17 is separated from the upper die 11 when the tip end configuration of the belt-shaped sheet 13 is formed, and holds the punch plate 17 in a state where the punch plate 17 is allowed to come near to the upper die 11 when the punch plate 17 is lifted, and an actuating mechanism 19 which operates the punch plate moving mechanism 18 in cooperation with a blanking or stamping operation of the upper die 11 only when the tip end configuration of the belt-shaped sheet 13 is formed. The above-described mechanisms will be described in detail below.

The punch plate moving mechanism 18 includes a fixed plate 28 which is provided in an upper part of the punch plate 17 so as to be urged upward and has a first irregular area 30 with first protruding parts 29 formed in an upper part at prescribed pitches P. Further, the punch plate moving mechanism 18 includes a movable plate 20 which is attached to the upper die 11 so as to be movable in a width direction and urged toward one side in a guide part (not shown in the drawing) formed along a width direction in a lower part of the receiving side for the belt-shaped sheet 13 in the upper die 11 and has a second irregular area 27 in a lower part of the other side with second protruding parts 26 formed at prescribed pitches P opposite to the first irregular area 30. Then, the second protruding parts 26 of the second irregular area 27 are butted against the first protruding parts 29 of the first irregular area 30 to separate the punch plate 17 from the upper die 11. The first protruding parts 29 of the first irregular area 30 are fitted to second recessed parts 26*a* of the second irregular area 27 to allow the punch plate 17 to come near to the upper die 11.

Here, at least one sides of side surfaces which respectively form the first and second protruding parts 29 and 26 and first and second recessed parts 29*a* and 26*a* of the first and second irregular areas 30 and 27 are inclined surfaces. Assuming that a maximum frictional coefficient when the inclined surfaces of the first and second protruding parts 29 and 26 abut on each other and shift from each other is $\mu$, an angle $\theta$ of inclination of the inclined surfaces (an angle of inclination to a horizontal plane) is set to an angle which satisfies an expression of $\tan\theta \leq \mu$. Thus, when the movable plate 20 is moved in the width direction, the inclined surfaces of the first and second protruding parts 29 and 26 can abut on each other and shift (slide) from each other. Thus, when a moving direction of the movable plate 20 is changed, the first and second irregular areas 30 and 27 can be engaged with each other and disengaged from each other.

The fixed plate 28 is attached to the upper die 11 through a spring (not shown in the drawing) which is one example of a first resilient member and held in a compressed state. Thus, the fixed plate 28 arranged in a lower side of the movable plate 20 can be urged toward the movable plate 20. The punch plate 17 is fixed to a lower part of the fixed plate 28 by using a bolt 38 as one example of a fastening member. On the other hand, the movable plate 20 has one end part formed in the shape of L in a plan view and holds one end of a spring 21 as one example of a second resilient member. Further, one side of the movable plate 20 is pressed to the upper die 11 through a holding member 24 fixed to a lower part of the upper die 11 by using a bolt 23 as one example of a fastening member. The holding member 24 holds the other side of the spring 21. According to such a structure, when the movable plate 20 is moved to the other side in the width direction of the upper die 11 in the guide part, the spring 21 can be held under a compressed state, so that the movable plate 20 can be urged toward the one side in the width direction of the upper die 11.

Here, a tip end (a lower end) of the second protruding part 26, a bottom of the second recessed part 26*a* of the second irregular area 27 and a tip end (an upper end) of the first protruding part 29 form horizontal planes, respectively. A height of the second protruding part 26 is lower than a height of the first protruding part 29. A length of the first protruding part 29 along the width direction of the upper die 11 is shorter than a length of the bottom of the second recessed part 26*a* of the second irregular area 27 along the width direction of the upper die 11. Further, a side surface of one side of the second protruding part 26 is parallel to a side surface of the other side of the first protruding part 29, and a side surface of the other side of the second protruding part 26 is parallel to a side surface of one side of the first protruding part 29.

Specifically, the second protruding part 26 can be configured as an equal leg trapezoidal form which has a lower bottom connected to a lower surface of the other side of the movable plate 20 longer than an upper bottom protruding downward. A length a of the upper bottom of the second trapezoidal protruding part 26 is shorter than the pitch P. Further, the first protruding part 29 can be configured as an equal leg trapezoidal form which has a lower bottom connected to an upper surface of the fixed plate 28 longer than an upper bottom protruding upward. The first and second protruding parts 26 and 29 have forms equal in length a of their upper bottom and different in their height (for instance, the height of the second protruding part 26 is lower than the height of the first protruding part 29). Accordingly, when the movable plate 20 is moved in the width direction of the upper die 11 relative to the fixed plate 28 to allow the second protruding part 26 to abut on the first protruding part 29, the fixed plate 28 (further, the punch plate 17 fixed thereto) can be lowered by the height of the second protruding part 26 relative to the upper die 11. Further, when the movable plate 20 is moved in the width direction of the upper die 11 relative to the fixed plate 28 to insert the first protruding part 29 into a gap between the adjacent protruding parts 26 (the second recessed part 26*a* of the second irregular area 27), the fixed plate 28 (further, the punch plate 17 fixed thereto) can be lifted by the height of the second protruding part 26 toward the upper die 11.

The actuating mechanism 19 includes a first engaging member 33 which is attached so as to vertically pass through a receiving side for a stripper holder 31 that holds the stripper plate 14 and urged upward through a spring 32 as one example of a resilient member held in a compressed state with an upper part engaged with a first engagement part 39 in one side of the movable plate 20. Further, the actuating mechanism 19 includes a second engaging member 37 which is provided in a lower surface of the receiving side of the stripper holder 31 through a spring 36 as one example of a resilient member held in a compressed state, and urged toward the other side (inside in the width direction) in the width direction of the stripper holder 31 with a tip end part engaged with a second engagement part 40 in a lower side of the first engaging member 33 which protrudes from the lower surface of the stripper holder 31. Here, one end of the spring 36 is held by the second engaging member 37 and the other end of the spring 36 is held by an attaching part 35 fixed to the stripper holder 31 by using a bolt 34 as one example of a fastening member.

The punch holding unit 15 has such a structure as described above. Thus, as shown in FIG. 1, when the tip end configuration of the belt-shaped sheet 13 is formed, the movable plate 20 is previously moved to the other side in the width direction of the upper die 11 relative to the fixed plate 28 to make the spring 21 compressed, so that the movable plate 20 can be urged toward the one side in the width direction of the upper die 11 and an upper bottom (a lower end face) of the second equal leg trapezoidal protruding part 26 can be allowed to abut on an upper bottom (an upper end face) of the first equal leg trapezoidal protruding part 29 (the first protruding part 29 of the first irregular area 30 can be butted against the second protruding part 26 of the second irregular area 27 so that the punch plate 17 is separated from the upper die 11).

Further, the first engagement part 39 is previously formed in a prescribed position of a lower surface side of the movable plate 20. Thus, when the movable plate 20 is moved to the other side in the width direction of the upper die 11 so that the upper end face of the first protruding part 29 abuts on the lower end face of the second protruding part 26 (the first protruding part 29 is butted against the second protruding part 26), the first engagement part 39 can be arranged at a position located above an end part of the first engaging member 33. Accordingly, when the spring 32 is held in its compressed state so as to urge the first engaging member 33 toward the movable plate 20, the end part of the first engaging member 33 can be fitted to the first engagement part 39. Thus, the moved movable plate 20 is engaged with the end part of the first engaging member 33, so that the movable plate 20 can be fixed. Further, when the spring 36 is held in the compressed state so that the second engaging member 37 is urged toward a base side of the first engaging member 33, the tip end part of the second engaging member 37 is allowed to abut on a part lower than the second engagement part 40 of the first engaging member 33 which protrudes to the lower surface side of the stripper holder 31. Thus, the second engaging member 37 can be made to be disengaged from the second engagement part 40.

Figure 2:
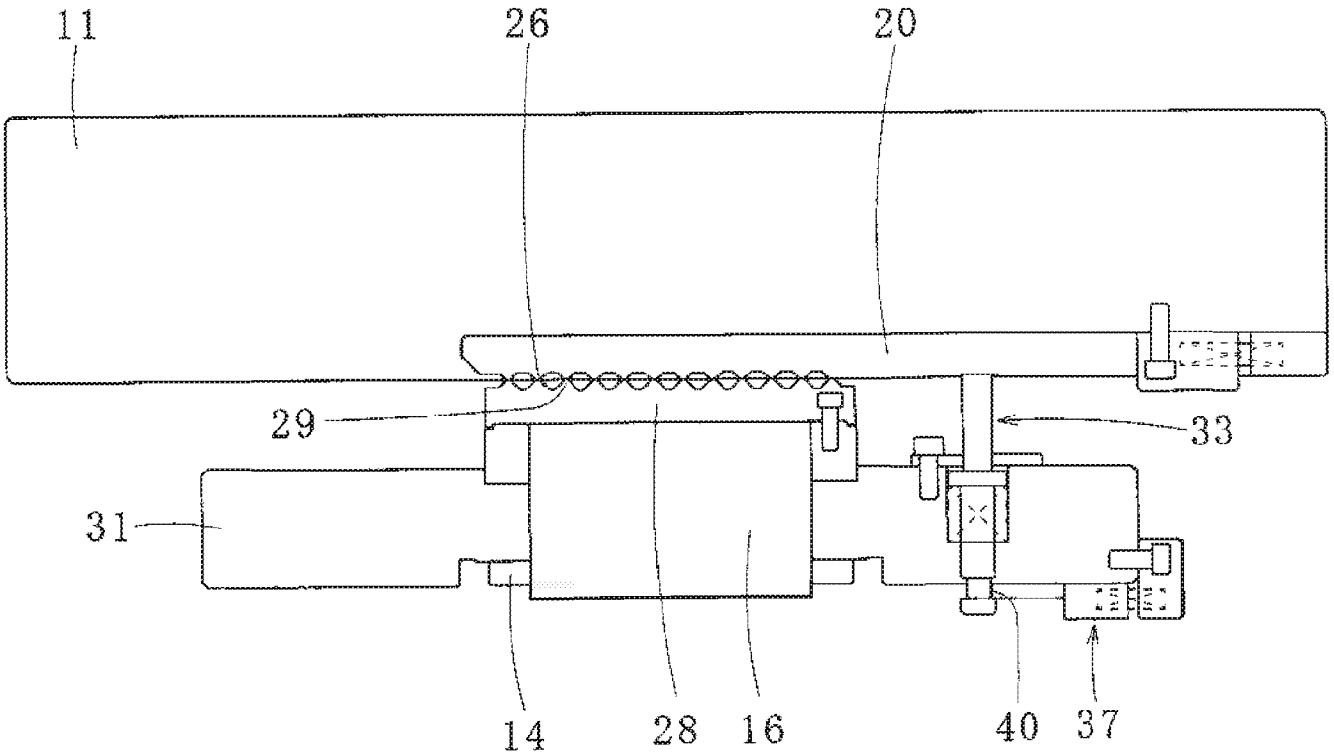
FIG. 2 is a front view when a tip end configuration of the belt-shaped sheet is formed by the die apparatus.

On the other hand, as shown in FIG. 1, when the lower end face of the second protruding part 26 is allowed to abut on the upper end face of the first protruding part 29, the fixed plate 28 can be separated (lowered) by the height of the second protruding part 26 relative to the upper die 11. Accordingly, a height position of an end of the tip end part blanking punch 16 can be moved downward relative to the upper die 11. As shown in FIG. 2, when the upper die 11 is lowered and the tip end part blanking punch 16 reaches a bottom dead center, the end of the tip end part blanking punch 16 can be protruded downward from the lower surface of the stripper plate 14. Thus, the tip end configuration of the belt-shaped sheet 13 can be formed by the tip end part blanking punch 16.

Here, when the tip end configuration of the belt-shaped sheet 13 is formed by the tip end part blanking punch 16, as the upper die 11 is lowered, the first engaging member 33 provided in the stripper holder 31 is lowered in a state where the end part is fitted to the first engagement part 39 of the movable plate 20. In this case, the stripper holder 31 stops its lowering movement when the stripper plate 14 abuts on a tip end part blanking die (not shown in the drawing) provided in the lower die 12 through the belt-shaped sheet 13. However, the upper die 11 further continues to be lowered. Accordingly, the first engaging member 33 attached to the stripper holder 31 is pressed by the upper die 11 through the movable plate 20, so that the first engaging member 33 is moved downward together with the upper die 11. Therefore, the second stepped engagement part 40 is previously formed in a prescribed position in a center side from the base end part of the first engaging member 33. Then, when the upper die 11 is further lowered so that the tip end part blanking punch 16 reaches the bottom dead center, the second engagement part 40 formed in the first engaging member 33 can be arranged before the tip end part of the second engaging member 37. As shown in FIG. 2, the tip end part of the second engaging member 37 can be fitted to the second engagement part 40 of the first engaging member 33. Thus, the second engaging member 37 is engaged with the second engagement part 40 so that the first engaging member 33 may be locked.

Figure 3:
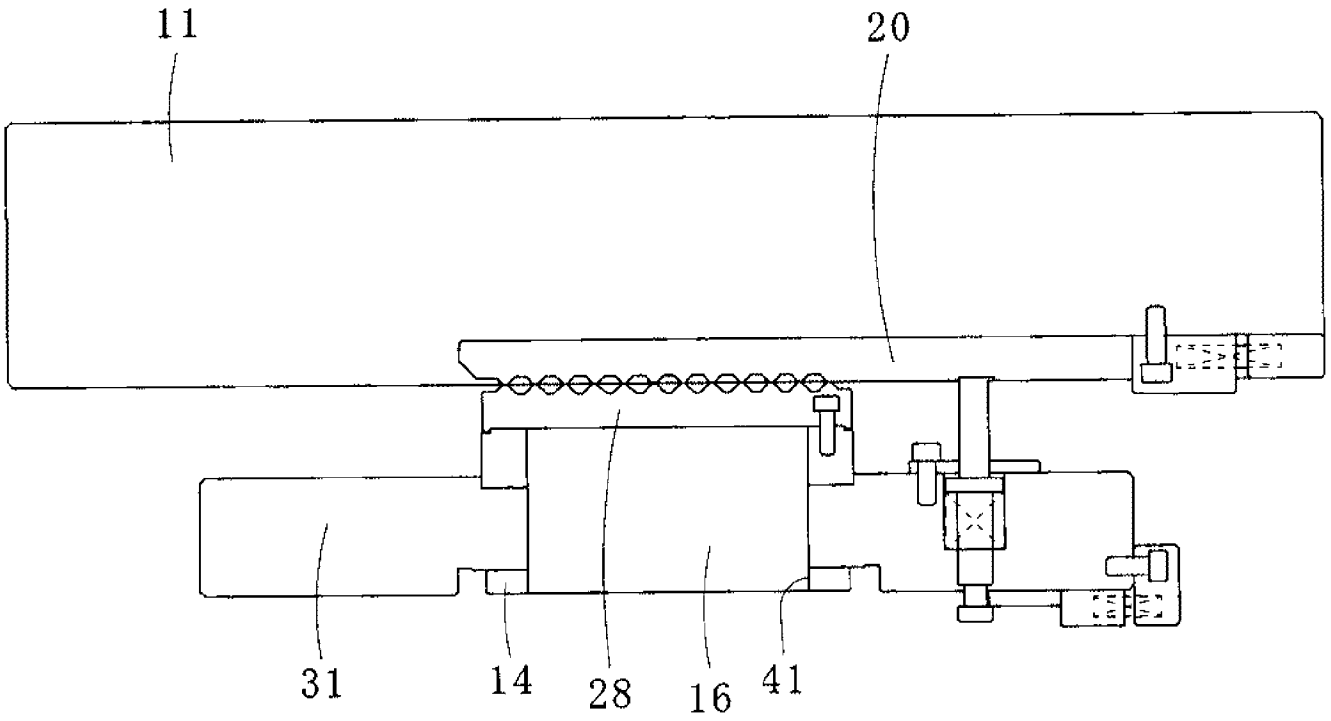
FIG. 3 is a front view when a tip end part blanking punch begins to be lifted after the tip end configuration of the belt-shaped sheet is formed by the die apparatus.

Immediately after the tip end part blanking punch 16 reaches the bottom dead center, the upper die 11 changes the lowering movement to a lifting movement. Here, the stripper plate 14 allows the belt-shaped sheet 13 to abut on the tip end part blanking die provided in the lower die 12 by a resilient member which is provided in the upper die 11 and is not shown in the drawing. Accordingly, even when the upper die 11 is lifted, the stripper holder 31 is not lifted. Accordingly, as shown in FIG. 3, as the upper die 11 is lifted, the end of the tip end part blanking punch 16 is moved to a position of the lower surface of the stripper plate 14 from a position lower than the lower surface of the stripper plate 14 to increase a distance between an upper surface of the stripper holder 31 and the lower surface of the movable plate 20 provided in the upper die 11.

Figure 4:
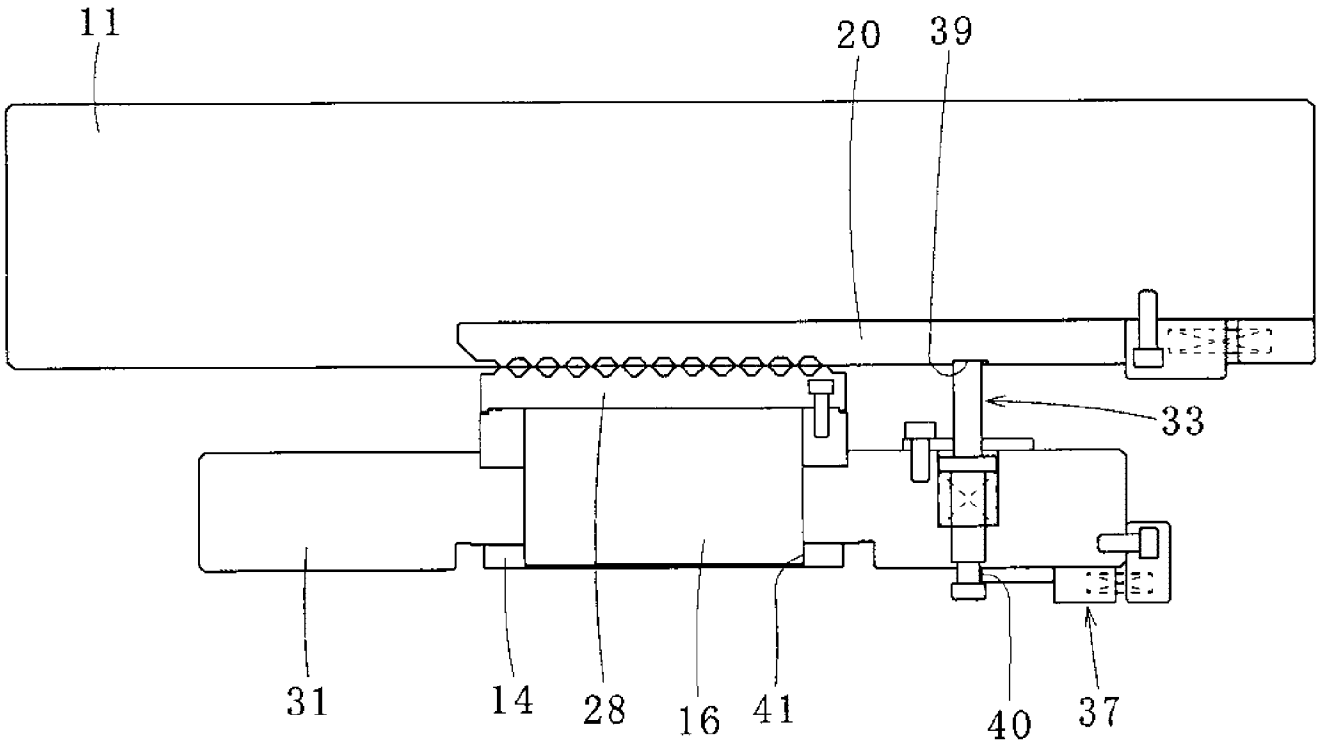
FIG. 4 is a front view when the tip end part blanking punch is lifted before a top dead center after the tip end configuration of the belt-shaped sheet is formed by the die apparatus.

When the upper die 11 is more lifted, the stripper holder 31 begins to be lifted, so that the belt-shaped sheet 13 is disengaged from the tip end part blanking die of the lower die 12 and the stripper plate 14 is located above the belt-shaped sheet 13. Then, as shown in FIG. 4, when the upper die 11 is lifted until the tip end part blanking punch 16 reaches a position located before a top dead center, the end of the tip end part blanking punch 16 is accommodated in an inside space 41 of the stripper plate 14 and the distance between the upper surface of the stripper holder 31 and the lower surface of the movable plate 20 provided in the upper die 11 is also more increased. Here, since the tip end part of the second engaging member 37 is fitted to the second engagement part 40 formed in the first engaging member 33, the first engaging member 33 is fixed to the stripper holder 31. Accordingly, when the distance between the upper surface of the stripper holder 31 and the lower surface of the movable plate 20 is increased, a distance between the end part of the first engaging member 33 fitted to the first engagement part 39 of the movable plate 20 and a bottom surface of the first engagement part 39 is increased.

Figure 5:
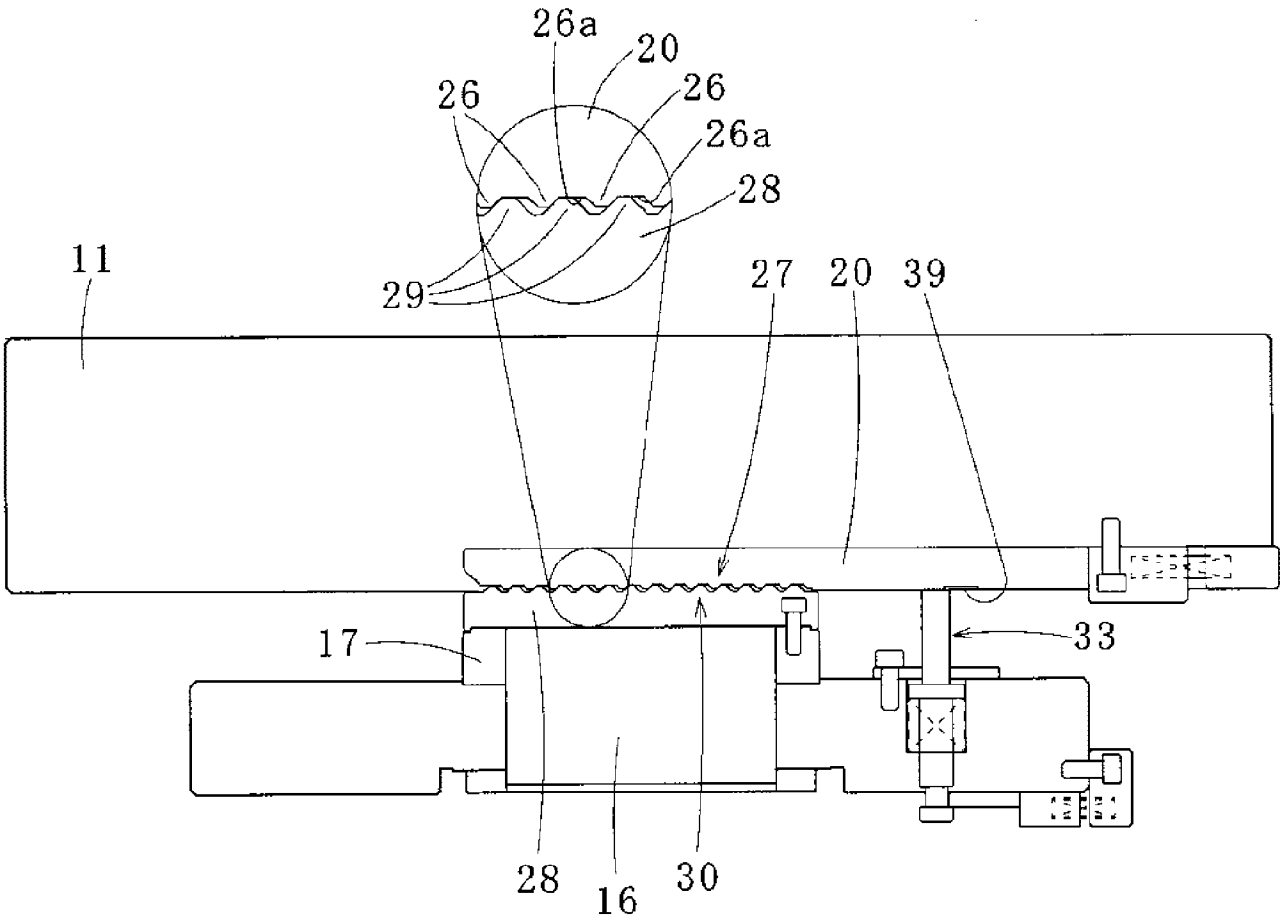
FIG. 5 is a front view when the tip end part blanking punch is lifted to the top dead center after the tip end configuration of the belt-shaped sheet is formed by the die apparatus.

Then, as shown in FIG. 5, when the upper die 11 is lifted until the tip end part blanking punch 16 reaches the position of the top dead center, the end part of the first engaging member 33 fitted to the first engagement part 39 of the movable plate 20 is disengaged from the first engagement part 39. Accordingly, a fixed state of the movable plate 20 is released. Thus, the movable plate 20 is moved toward the one side in the width direction of the upper die 11. On the other hand, since the fixed plate 28 is urged toward the movable plate 20, when the movable plate 20 is moved so that the gap between the adjacent protruding parts 26 of the second irregular area 27 (the second recessed part 26*a* of the second irregular area 27) is located above the first protruding part 29 of the first irregular area 30 formed in the fixed plate 28, the first protruding part 29 of the fixed plate 28 is inserted into the second recessed part 26*a* of the movable plate 20. Thus, the fixed plate 28 is lifted by the height of the second protruding part 26 toward the movable plate 20 (the upper die 11).

Here, the angle θ of inclination of the side surface of the second protruding part 26 is equal to the angle θ of inclination of the side surface of the first protruding part 29. The angle θ of inclination satisfies a relation expressed by tan θ≤μ to the maximum frictional coefficient μ when the side surfaces of the first and second protruding parts 29 and 26 abut on each other. Therefore, the first protruding part 29 is inserted into the recessed part while the side surface of the first protruding part 29 is allowed to abut on the side surface of the second protruding part 26 (namely, while the movable plate 20 is moved toward the one side, a height position of the fixed plate 28 relative to the movable plate 20 is gradually lifted upward toward the movable plate 20). Then, since the first protruding part 29 is higher than the second protruding part 26, when the upper end face of the first protruding part 29 abuts on the bottom surface of the second recessed part 26*a*, an insertion of the first protruding part 29 (a lifting movement of the fixed plate 28 relative to the movable plate 20) is stopped. Further, in a state where the insertion of the first protruding part 29 relative to the second recessed part 26*a* stops, since the side surface of the one side of the first inserted protruding part 29 of the fixed plate 28 abuts on the side surface of the other side of the second protruding part 26 of the movable plate 20, the movable plate 20 is moved toward the one side until the side surface of the other side of the first inserted protruding part 29 of the fixed plate 28 abuts on the side surface of the one side of the second opposed protruding part 26. Accordingly, when the movement of the movable plate 20 is stopped (the first and second irregular areas 30 and 27 are engaged with each other), the fixed plate 28 is fixed to the upper die 11 through the movable plate 20. Consequently, an operation of the tip end part blanking punch 16 is stopped.

Figure 6:
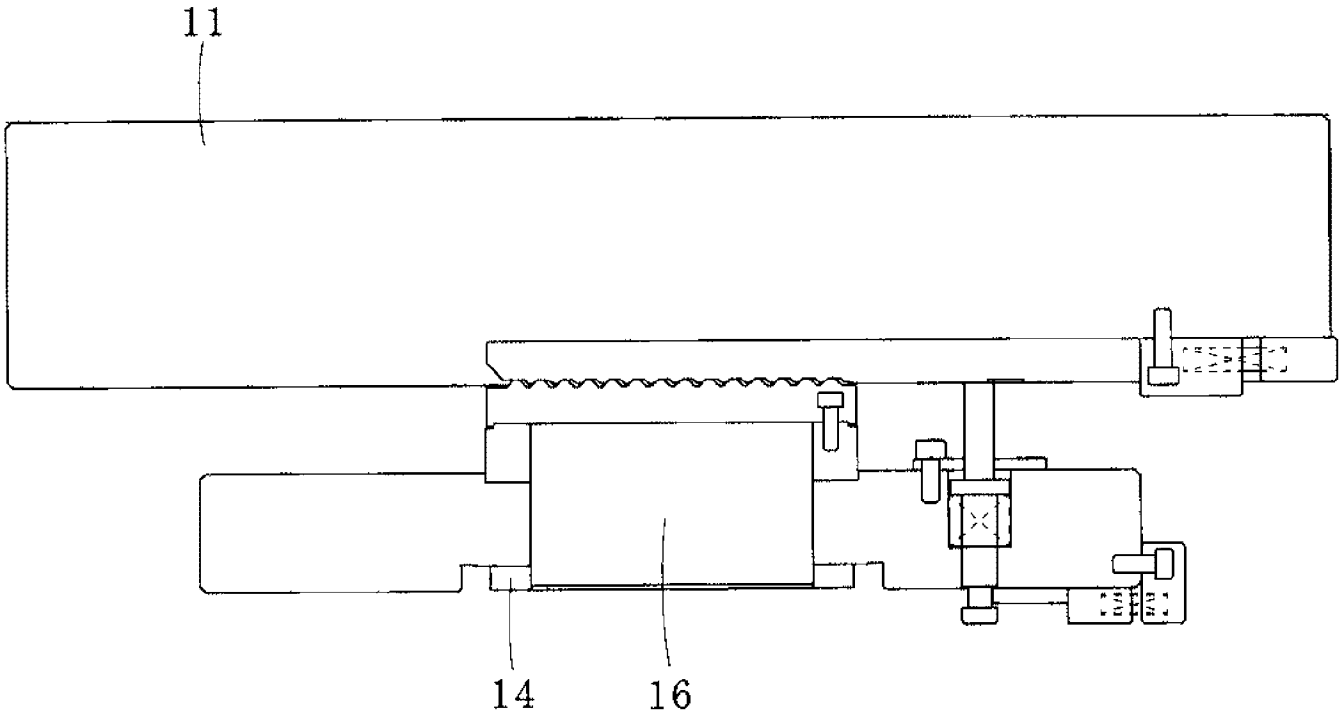
FIG. 6 is a front view when a blanking or stamping work of an iron core is carried out after the tip end configuration of the belt-shaped is formed by the die apparatus.
Figure 7A:
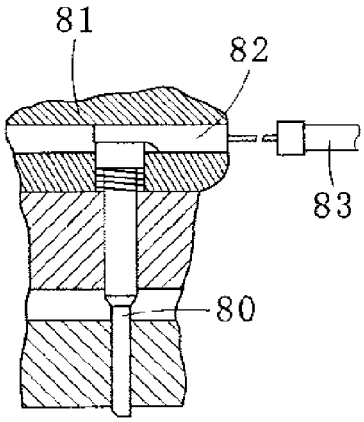
FIG. 7A and FIG. 7B are explanatory views of an intermittent blanking mechanism according to a related art example.
Figure 7B:
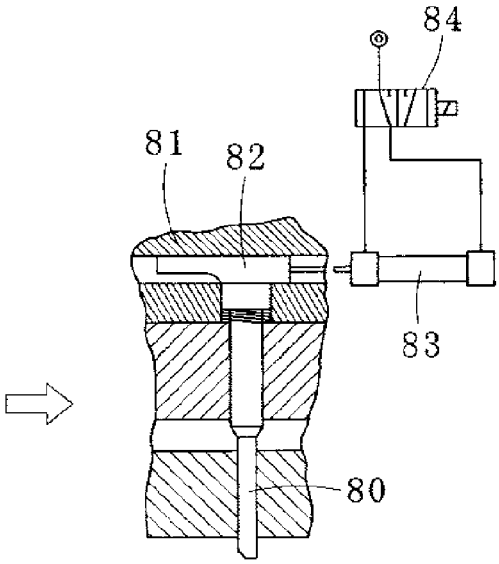

When the upper die 11 is lifted until the tip end part blanking punch 16 reaches the position of the top dead center, as shown in FIG. 5, a vertical position of the punch plate 17 which holds the tip end part blanking punch 16 comes nearer by the height of the second protruding part 26 to the upper die 11 (lifted toward the upper die 11 side) as compared with FIG. 1. Accordingly, as shown in FIG. 6, after the tip end configuration of the belt-shaped sheet 13 is formed, when the upper die 11 is lowered to blank or stamp the belt-shaped sheet 13 by the blanking punch, namely, when the blanking punch reaches a bottom dead center, the end position of the tip end part blanking punch 16 can be held above the position of the lower surface of the stripper plate 14. Thus, when the multi-row iron cores are taken from the belt-shaped sheet 13, the operation of the tip end part blanking punch 16 can be stopped (the blanking or stamping work by the tip end part blanking punch 16 is prevented from being carried out), blanked or stamped residue by the tip end part blanking punch 16 can be prevented from being generated in the die apparatus 10 and a cutting tool of the die apparatus 10 can be assuredly prevented from being broken.

Subsequently, an operation of a control method in the die apparatus according to one exemplary embodiment will be described below.

The control method in the die apparatus is, as shown in FIG. 1, a control method in the die apparatus which includes the upper die 11 and the lower die 12 and is used when the progressively fed belt-shaped sheet 13 is allowed to abut on the blanking die of the lower die 12 by the stripper plate 14 provided in the upper die 11 and sequentially carry out the blanking or stamping work by using the blanking punch provided in the upper die 11 so as to blank or stamp out the iron core (for instance, the multi-row iron cores are obtained). In the receiving side for the belt-shaped sheet 13 in the upper die 11, the tip end part blanking punch 16 is provided which forms the tip end configuration of the belt-shaped sheet 13. When the tip end configuration of the belt-shaped sheet 13 is formed, the moment the tip end part blanking punch 16 reaches the bottom dead center, the end of the tip end part blanking punch 16 is allowed to protrude downward from the lower surface of the stripper plate 14. Accordingly, when the tip end side of the belt-shaped sheet 13 is inserted into the die apparatus 10 and the tip end part blanking punch 16 is lowered to the bottom dead center in a state where the tip end side of the belt-shaped sheet 13 is allowed to abut on the tip end part blanking die provided in the lower die 12 by the stripper plate 14, the tip end configuration of the belt-shaped sheet 13 can be formed by the tip end part blanking punch 16.

Further, when the belt-shaped sheet 13 is blanked or stamped by the blanking punch after the tip end configuration of the belt-shaped sheet 13 is formed, the end position of the tip end part blanking punch 16 is held above the position of the lower surface of the stripper plate 14 which allows the belt-shaped sheet 13 to abut on the blanking die of the lower die 12. Accordingly, when the blanking punch is lowered to the bottom dead center to blank or stamp out the iron core from the belt-shaped sheet 13 in a state where the belt-shaped sheet 13 inserted into the die apparatus 10 is allowed to abut on the blanking die provided in the lower die 12 by the stripper plate 14, the blanked or stamped residue by the tip end part blanking punch 16 can be prevented from being generated in the die apparatus 10. As a result, the cutting tool of the die apparatus 10 can be assuredly prevented from being broken.

The present invention is described above by referring to the exemplary embodiments. However, the present invention is not limited to the structure described in the above-described exemplary embodiments and may include other exemplary embodiments or modified examples which can be considered within a scope of matters described in claims.

Further, combinations of the component elements respectively included in the present exemplary embodiments and other exemplary embodiments or modified examples may be included in the present invention.

For instance, both the form of the second protruding part formed in the movable plate and the form of the first protruding part formed in the fixed plate are designated as the equal leg trapezoidal forms. However, when both the protruding parts have such forms as to be inserted to each other, the forms are not limited to the equal leg trapezoidal forms. For instance, a parallelogram may be used.

Further, when the tip end configuration of the belt-shaped sheet is formed, the die apparatus is not limited to a case that the multi-row iron cores are taken, and may be used when the single-row iron core is taken.

What is claimed is:

1. A die apparatus comprising:

an upper die including a stripper plate and a blanking punch; and a lower die, wherein the die apparatus is configured to perform a blanking or stamping operation that is sequentially carried out on a sheet by using the blanking punch to blank or stamp out an iron core, the die apparatus further including:

a tip end part blanking punch provided at the upper die and configured to blank a tip end part of the sheet through a punch holding unit, wherein the punch holding unit includes:

a punch plate which holds the tip end part blanking punch such that the tip end part blanking punch is movable with the punch plate;

a punch plate moving mechanism configured to lower the punch plate into a lowered state such that the punch plate is separated from the upper die when the tip end part of the sheet is blanked, and to raise the punch plate in a raised state such that the punch plate is closer to the upper die than when the punch plate is in the lowered state; and an actuating mechanism which operates the punch plate moving mechanism during the blanking or stamping operation of the upper die only when the tip end part of the sheet is blanked, and wherein when the tip end part blanking punch reaches a bottom dead center, an end of the tip end part blanking punch is protruded downward from a lower surface of the stripper plate, whereas when the sheet is blanked or stamped by the blanking punch after the tip end part of the sheet is blanked, the end of the tip end part blanking punch is held above the lower surface of the stripper plate.

2. The die apparatus according to claim 1, wherein the punch plate moving mechanism includes:

a fixed plate which is provided in an upper part of the punch plate so as to be urged upward and has a first irregular area with first protruding parts formed in an upper part and spaced at prescribed distances from each other; and a movable plate which is attached to the upper die so as to be movable in a width direction of the upper die and urged toward one side in the width direction and has a second irregular area in a lower part of the other side in the width direction with second protruding parts spaced at prescribed distances from each other opposite to the first irregular area, wherein the second protruding parts of the second irregular area are butted against the first protruding parts of the first irregular area to separate the punch plate from the upper die, whereas the first protruding parts of the first irregular area are fitted to second recessed parts of the second irregular area to allow the punch plate to come near to the upper die.

3. The die apparatus according to claim 2, wherein at least one sides of side surfaces which respectively form the first and second protruding parts and the first and second recessed parts of the first and second irregular areas are inclined surfaces, and the movable plate is moved in the width direction of the upper die so that the first and second irregular areas are engaged with each other and disengaged from each other.

4. The die apparatus according to claim 2, wherein an end of the second protruding part, a bottom of a second recessed part of the second irregular area and an end of the first protruding part form horizontal planes, respectively, a height of the second protruding part is lower than a height of the first protruding part, a length of the first protruding part along the width direction of the upper die is shorter than a length of the bottom of the second recessed part of the second irregular area along the width direction of the upper die, and an inclined side surface of one side of the second protruding part is parallel to an inclined side surface of the other side of the first protruding part, and an inclined side surface of the other side of the second protruding part is parallel to an inclined side surface of one side of the first protruding part.

5. The die apparatus according to claim 2, wherein the fixed plate is urged toward the upper die through a first resilient member and the movable plate is urged toward the one side in the width direction through a second resilient member.

6. The die apparatus according to claim 1, wherein the actuating mechanism includes:

a first engaging member which is attached so as to vertically pass through a receiving side of a stripper holder that holds the stripper plate, and urged upward with an upper part of the first engaging member engaged with a first engagement part in the one side of the movable plate; and a second engaging member which is provided in a lower surface of the receiving side of the stripper holder and urged inside in the width direction of the stripper holder with a tip end part of the second engaging member engaged with a second engagement part in a lower side of the first engaging member which protrudes below the lower surface of the stripper holder, wherein an operation of the tip end part blanking punch is configured to be stopped by the following state transitions of the actuating mechanism:

in a state where the first engaging member is engaged with the first engagement part, the second engaging member is disengaged from the second engagement part;

when the upper die is lowered, the second engaging member is engaged with the second engagement part to lock the first engaging member; and when the upper die is lifted, the first engaging member is disengaged from the first engagement part and the movable plate is moved toward the one side in the width direction so that the first and second irregular areas are engaged with each other.

7. A control method in a die apparatus that comprises:

an upper die including a stripper plate and a blanking punch;

and a lower die, wherein the die apparatus is configured to perform a blanking or stamping operation that is sequentially carried out on a sheet by using the blanking punch to blank or stamp out an iron core, the control method comprising:

providing a tip end part blanking punch at the upper die to blank a tip end configuration of the sheet;

allowing an end of the tip end part blanking punch to protrude downward from a lower surface of the stripper plate when the tip end configuration of the sheet is blanked; and holding an end of the tip end part blanking punch above a position of the lower surface of the stripper plate when the sheet is blanked or stamped by the blanking punch after the tip end configuration of the sheet is blanked.

* * * * *